United States Patent [19]

Mayer et al.

[11] Patent Number: 4,578,045

[45] Date of Patent: Mar. 25, 1986

[54] ACTION FIGURE WITH LEG MOVEMENT DERIVED FROM ARM MOVEMENT

[75] Inventors: John F. Mayer, Fort Thomas, Ky.; Nick H. Langdon, Cincinnati, Ohio; Stuart A. Cook, New Richmond, Ohio; L. Todd Nicholson, Cincinnati, Ohio; John R. Belcher, Opelika, Ala.

[73] Assignee: CPG Products Corp., Minneapolis, Minn.

[21] Appl. No.: 574,826

[22] Filed: Jan. 30, 1984

[51] Int. Cl.[4] ..... A63H 3/20

[52] U.S. Cl. ..... 446/330; 446/156; 446/333; 446/336; 446/381

[58] Field of Search ..... 446/153, 156, 158, 330, 446/333, 334, 336, 352–355, 376, 377, 379, 381, 361–363

[56] References Cited

U.S. PATENT DOCUMENTS

| | | | |
|---|---|---|---|
| 207,188 | 8/1878 | Martin | 446/158 |
| 839,770 | 12/1906 | Kalkbrenner | 446/362 |
| 1,725,919 | 8/1929 | Ivey | 446/362 |
| 2,288,371 | 6/1942 | Rothschild | 446/354 |
| 2,761,243 | 9/1956 | Baggott | 446/377 |
| 3,835,581 | 9/1974 | Grieder | 446/158 |

*Primary Examiner*—F. Barry Shay

*Attorney, Agent, or Firm*—Gene O. Enockson; L. MeRoy Lillehaugen; Stuart R. Peterson

[57] ABSTRACT

The action figure includes two arms mounted to the figure's torso for rocking movement toward the torso about laterally spaced axes, the action figure also including two legs that are mounted for pivotal movement to the torso in a scissors-like fashion. Integral with the rockable mounting means for each arm is an inwardly extending shank, the shanks projecting into end portions of a coil spring. When either arm is moved laterally toward the side of the torso, the spring is flexed into a V-shaped configuration. A link extends downwardly from the center of the spring so that the flexing action imparted to the spring causes the link to move downwardly or upwardly. Each unit for pivotally mounting the legs includes a crank pin that is receivable in forwardly and rearwardly located slots at the lower end of the link. The arms can be independently swung from a position adjacent the sides of the figure to overhead or outstretched positions without affecting their ability to oscillate the legs in a scissors-like manner and thereby simulate running, swimming and kicking movements.

19 Claims, 14 Drawing Figures

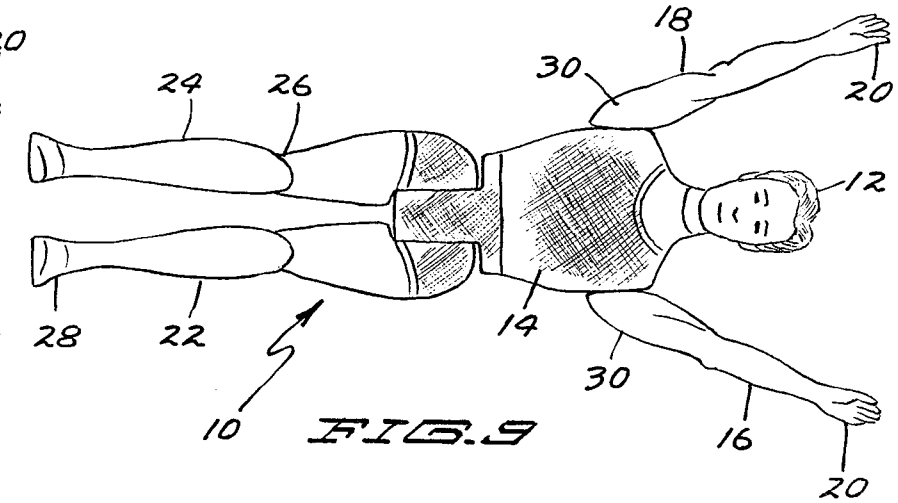
FIG. 9
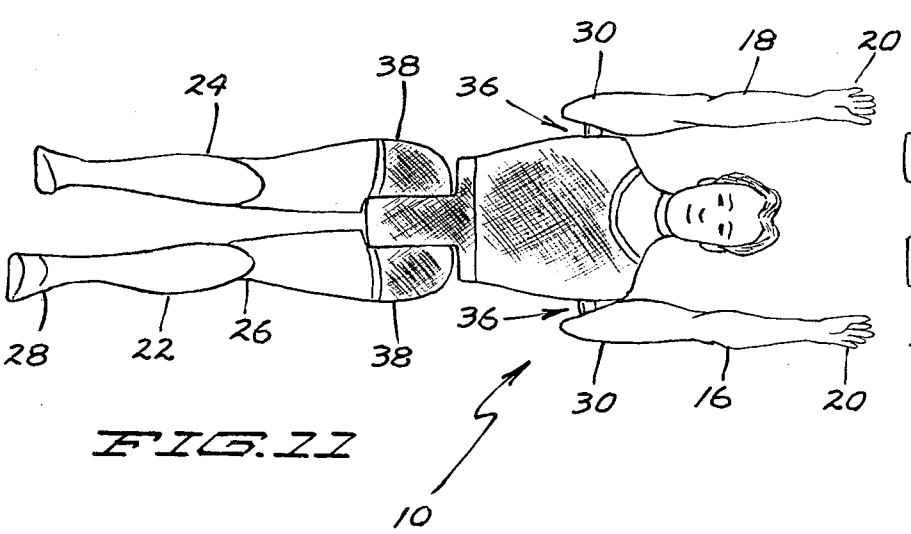
FIG. 11
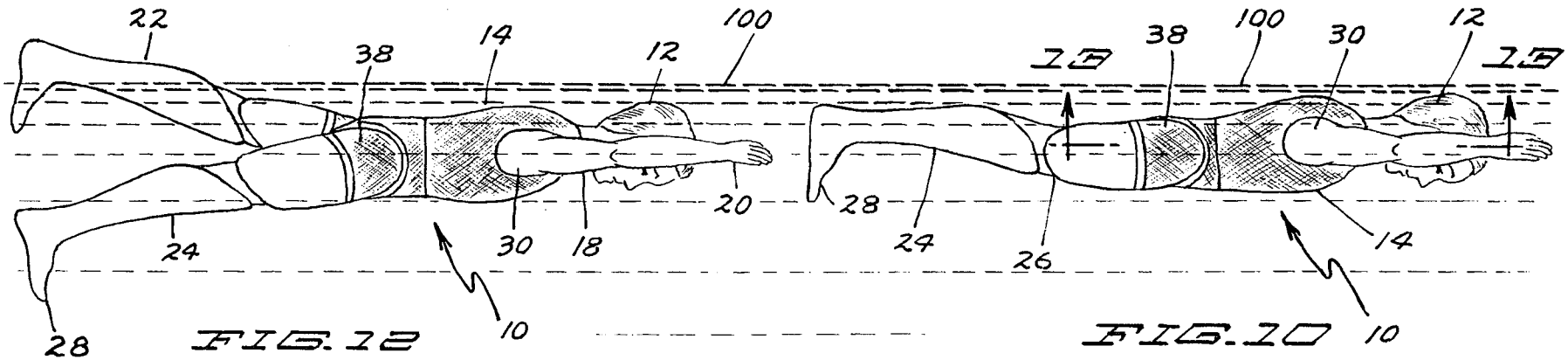
FIG. 10
FIG. 12

ACTION FIGURE WITH LEG MOVEMENT DERIVED FROM ARM MOVEMENT

BACKGROUND OF THE INVENTION

1. Field of the Invention

This invention relates generally to toy figures having movable limbs, and pertains more particularly to an action figure in which a desired type of leg movement is derived from a special type of arm movement.

2. Description of the Prior Art

The patent literature is replete with disclosures of various dolls and the like in which various limb movements are produced. One such doll is described in U.S. Pat. No. 4,069,613, granted on Jan. 24, 1978 to Jerome H. Lemelson et al, titled "ACTIVITY DOLL." While this particular doll possesses a relatively simple actuating mechanism, it does involve a push-button type of manipulation in order to move either an arm or a leg.

Examples of dolls having multiple limb movements that are derived from the movement of but one limb are exemplified in U.S. Pat. No. 2,761,243, issued to Edmund W. Baggott on Sept. 4, 1956 for "WALKING AND CRAWLING DOLL", U.S. Pat. No. 2,978,834, issued on Apr. 11, 1961 to Robert Gardel et al for "DOLL CRAWLING MECHANISM" and U.S. Pat. No. 2,978,835 granted on Apr. 11, 1961 to Robert Gardel et al for "DOLL CRAWLING MECHANISM." Specifically, the alluded to patents are concerned with dolls that walk or crawl.

Still other toy figures are specifically concerned with simulating swimming motions. In this category is U.S. Pat. No. 140,259, issued to Isaac F. Eaton on June 4, 1873 for "TOY AUTOMATIC SWIMMERS." Two or more recent "swimming" patents are U.S. Pat. No. 3,601,922, issued on Aug. 31, 1971 to James W. Shaffer for "SWIMMING DOLL" and U.S. Pat. No. 4,135,326 granted on Jan. 23, 1979 to Duncan Tong for "AQUATIC FIGURE TOY." The three patents just identified require a motor operation and are quite costly and detailed.

SUMMARY OF THE INVENTION

An object of the present invention is to provide an action figure in which a desired type of leg movement, more specifically a kicking, running or swimming type of movement, is produced in response to a special type of arm movement. In this regard, it is an aim of the invention to provide an action figure in which the manipulation of one arm, or both arms, in a lateral direction will produce a leg movement of a specific type, more precisely a movement that resembles a kicking, running or swimming action. In this regard, it is contemplated that the arms be moved manually toward the sides of the figure's torso, or toward each other if raised above the figure's head, and that an actuating mechanism inside the torso cause one or both legs to swing in a scissors-like fashion.

Another object of the invention is to provide an actuating mechanism that is entirely housed within the action figure so that the mechanism is completely concealed from view, thereby enabling a realistic appearance to be imparted to the selected action figure. In this regard, it can be pointed out that an aim of the invention is to provide action figures that can simulate or resemble various comic strip personalities. In this regard, various leg movements are associated with certain well-known comic characters, and it is within the scope of the present invention to simulate such movements.

Yet another object of the invention is to provide an actuating mechanism that is inexpensive to manufacture, thereby enabling action figures employing the present invention to be fabricated and sold at relatively low prices. Also, it is an aim of the invention to provide an actuating mechanism that is simple, rugged and not apt to get out of order readily, thereby assuring a relatively long life for the toy.

Still further, an object of the invention is to provide an actuating mechanism that enables the particular figure to be miniaturized, yet still achieving the sought after limb movement or movements.

Another object of the invention is to provide a toy figure that will be appealing to children of various ages. In this regard, a goal of the invention is to provide an action figure having desired limb movements that can be effected via only a simple movement of but one other limb, or if desired two other limbs.

Also, the invention has for an object the mounting of the arms and legs to the figure's torso in such a way that each limb can be shifted independently of the other. More specifically, an aim is to permit any selected arm or leg to be pivoted in a human-like manner, yet still enabling either arm, irrespective of the position into which it has been swung, to be manually actuated so as to produce a desired leg movement.

Briefly, our invention contemplates a small and compact action figure, which figure can be in the form of a human being, an animal or a fictitious comic strip character, in which the lateral movement of either arm toward the toy's torso will effect a kicking, running or scissors-like swimming action of both legs. The arms are so mounted that either or both arms can be manipulated to effect the leg movement. It is also within the scope of the invention to have only one leg actuated when either or both arms are moved, the action in this situation simulating a kicking action which certain comic strip characters are known to have. The arms and legs are also mounted so that either arm or leg can be pivoted about its shoulder or hip axis. The actuating mechanism includes a coil spring connected at its opposite ends to the toy's arms which are pivotally attached to the torso sides so that the arms can be manipulated in opposite directions away from the sides of the torso. The flexing of the coil spring causes a link to be moved downwardly. By means of crank pins engaged in slots at the lower end of the link the leg mounting units for the two legs are caused to pivot or swing in opposite directions, the resulting scissors-like movement resembling the leg movement of a swimmer.

BRIEF DESCRIPTION OF THE DRAWINGS

FIG. 8 is a sectional view taken along the line 8—8 of FIG. 7;

FIG. 9 is a bottom plan view looking up at an action figure, the action figure in this instance being in the form of swimmer at rest or in an unactuated condition;

FIG. 10 is an unactuated or quiescent condition of the action figure of FIG. 9, the view being taken from the right;

FIG. 11 is a view corresponding to FIG. 9 but with both arms actuated inwardly for the purpose of effecting a pivotal movement of both legs to simulate a swimming condition;

FIG. 12 is a side view corresponding to FIG. 10 but with the legs actuated as in FIG. 11;

FIG. 13 is a sectional view taken in the direction of line 13—13 of FIG. 12, the view being similar to FIG. 7 but showing the arms having been pressed toward each other as in FIGS. 11 and 12, and FIG. 14 is a sectional view taken in the direction of line 14—14 of FIG. 13.

DESCRIPTION OF THE PREFERRED EMBODIMENT

Figure 1:
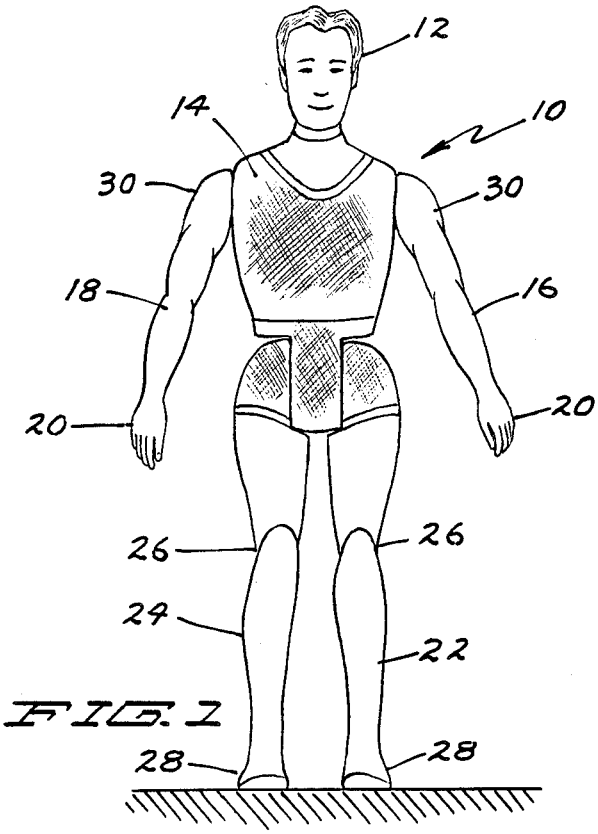
FIG. 1 is a front elevational view of an action figure exemplifying the invention, the action figure being in the form of a runner at rest or in an unactuated condition and the view being from the front.
Figure 2:
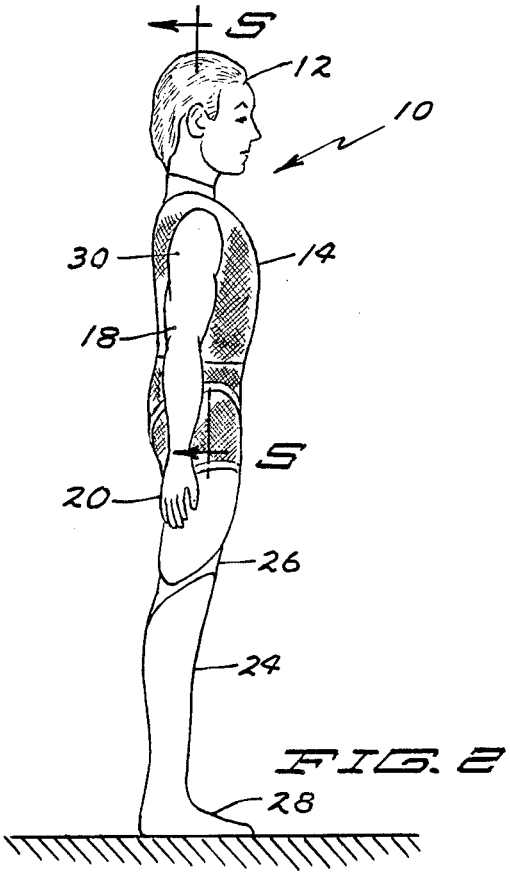
FIG. 2 is an unactuated or quiescent condition of the action figure, the view being taken from the right in FIG. 1.
Figure 3:
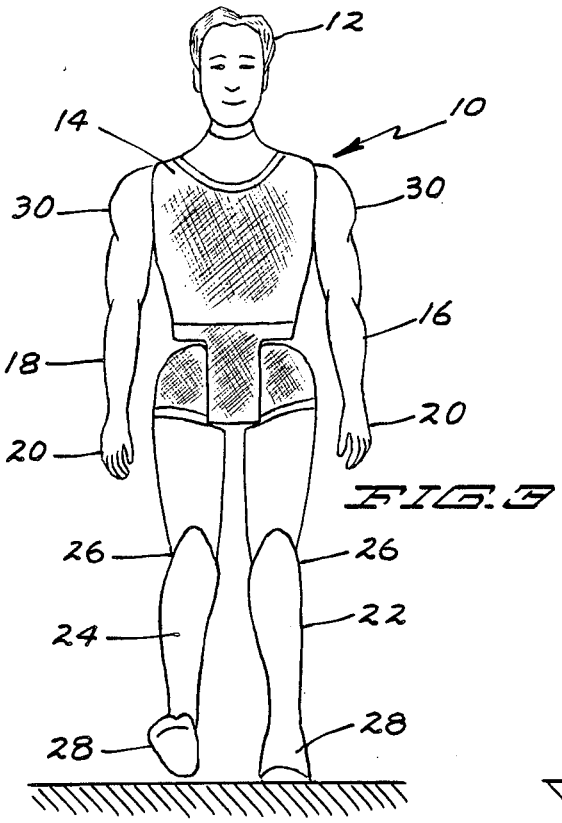
FIG. 3 is a view corresponding to FIG. 1 but with both arms actuated inwardly for the purpose of effecting a pivotal movement of both legs to simulate a running condition.

The toy is illustrated as a male action figure, the figure being indicated generally by the reference numeral 10. The action FIG. 10 includes a head 12 and a hollow torso 14, the torso 14 being comprised of two plastic shells suitably secured together. The action FIG. 10 additionally includes a left arm 16, a right arm 18, each arm having a hand 20. Still further, the action FIG. 10 is provided with a left leg 22 and a right leg 24, each leg having a knee 24 and a foot 28. Although not pertinent to the present invention, it can be pointed out that each knee 26 can flex to simulate an actual knee movement. In the present situation, it is intended that both arms 16 and 18 be capable of rocking movement, more specifically in opposite lateral directions away from the sides of the torso 14. FIG. 1 shows the arms 16 and 18 before they are swung laterally toward the torso 14, whereas FIG. 3 depicts the arms 16 and 18 after they have been pressed inwardly toward the sides of the torso 14 to cause actuation of the legs 22 and 24 in a manner yet to be described.

Figure 5:
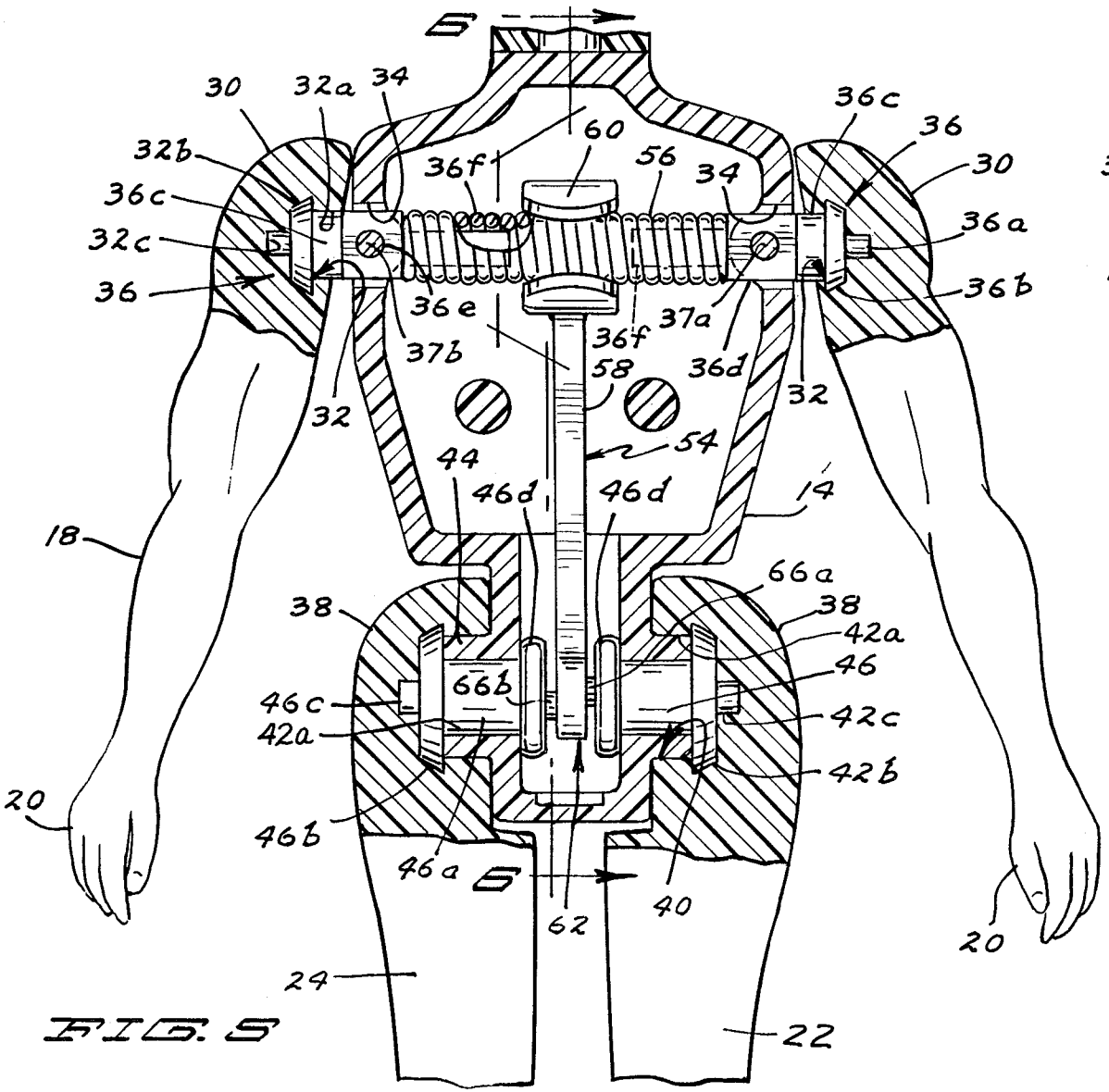
FIG. 5 is a vertical sectional view taken along the line 5—5 of FIG. 2, the view being appreciably enlarged.
Figure 6:
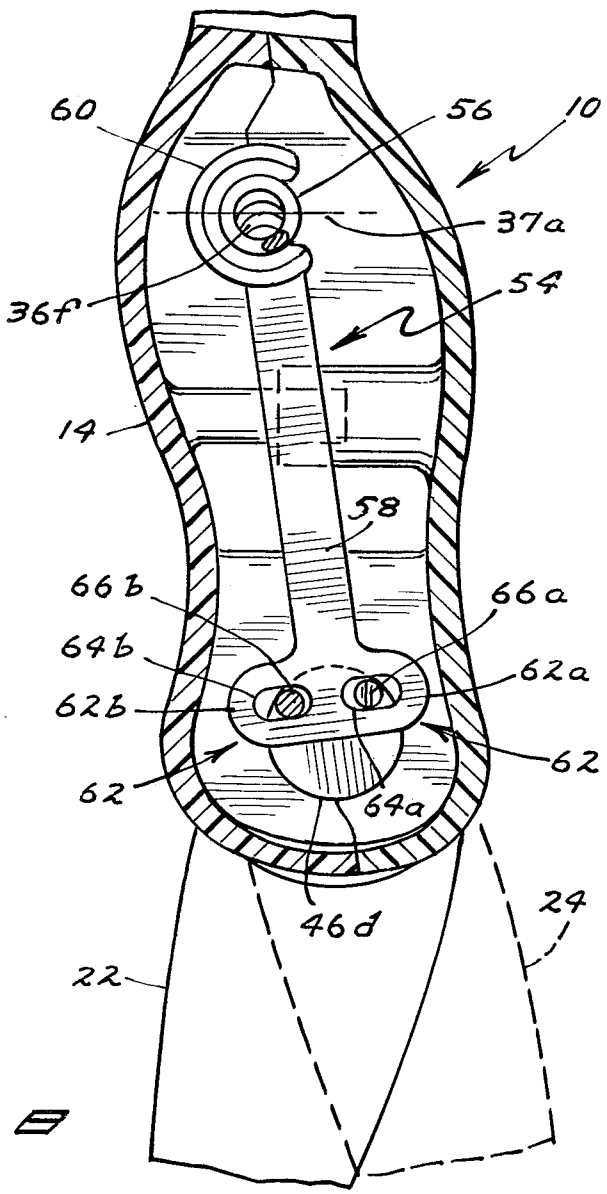
Figure 7:
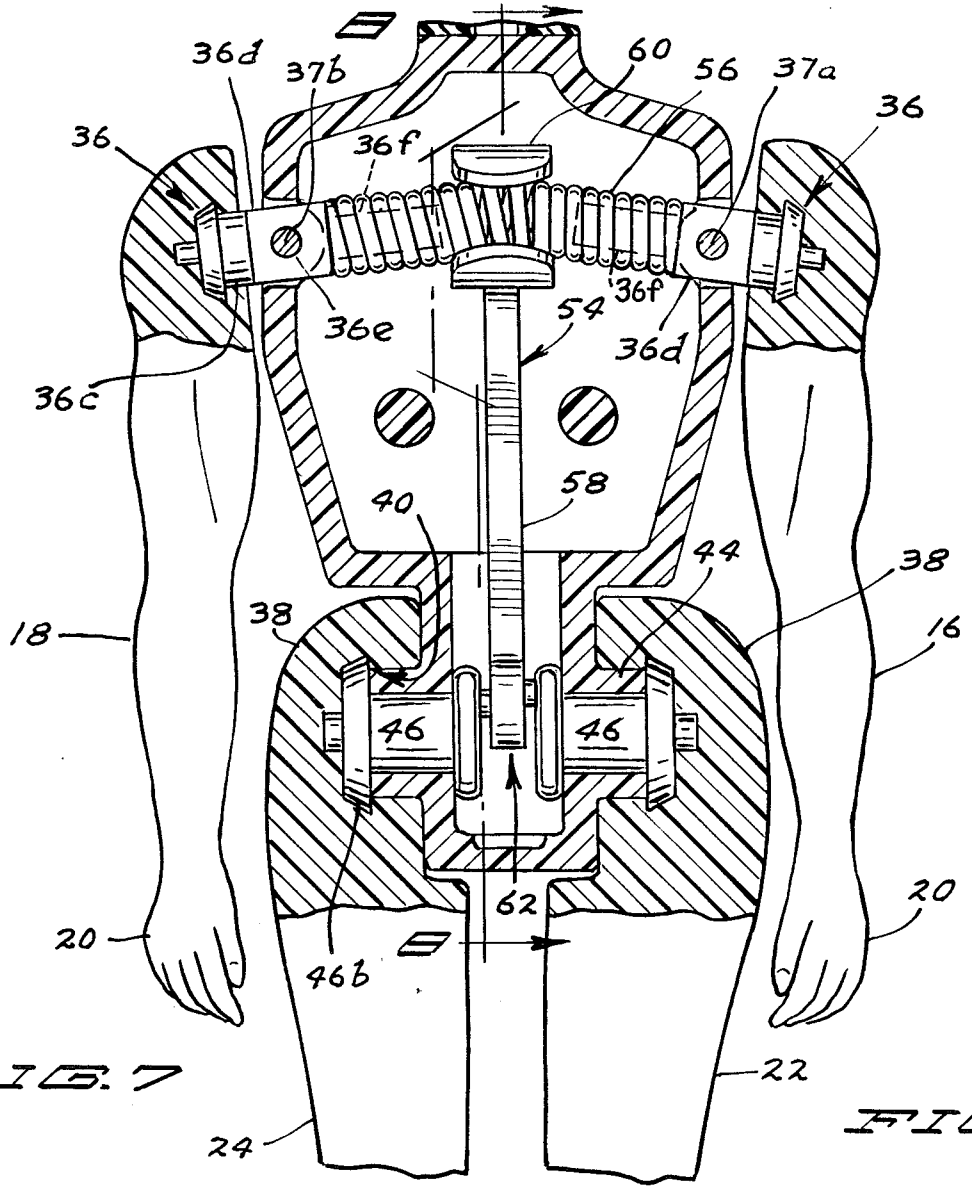
FIG. 7 is a sectional view taken in the direction of line 7—7 of FIG. 4, the view corresponding to FIG. 5, but with the arms having been pressed toward the figure's torso to effect movement of both legs.
Figures 7A, 7B:
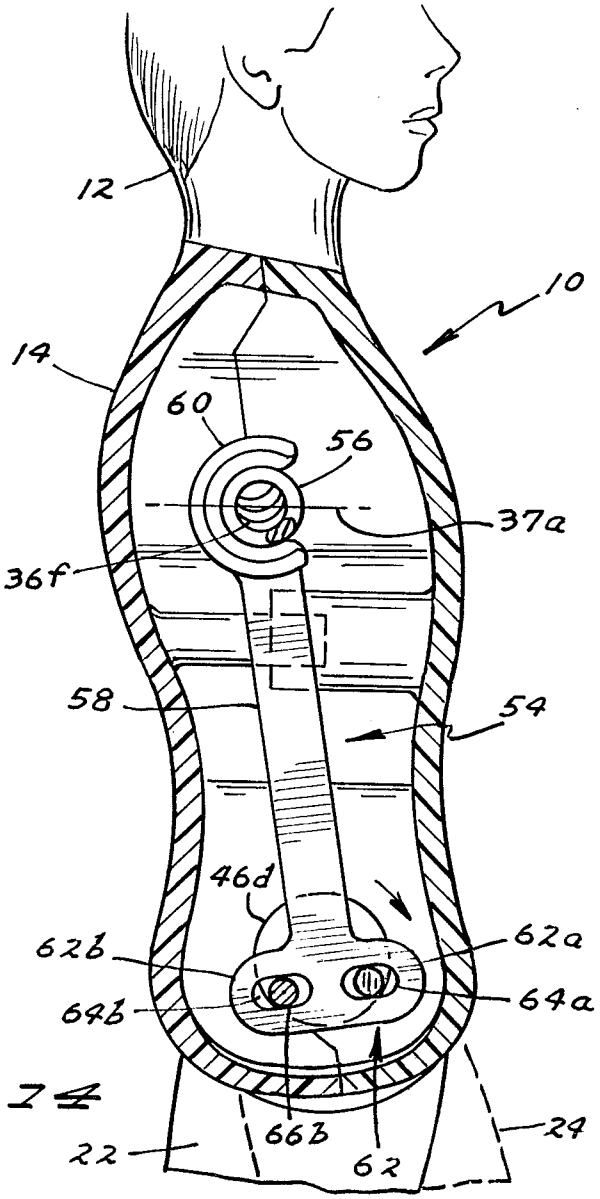

As can be understood from FIGS. 5, 7 and 13, there is shown a shoulder labeled 30 for each arm 16, 18 having a socket 32 formed therein that is comprised of a cylindrical bore 32*a*, an annular groove 32*b* and a counterbore 32*c*. Additionally, it is to be noted that the torso 14 is formed with an opening 34 at each side thereof.

There is an arm mounting unit 36 for each arm 16, 18. The arm mounting unit 36 includes an outer cylindrical tip 36*a* which is received in the counterbore 32*c*, a rib or flange 36*b* which is press fitted in the annular groove 32*b*, a sleeve or cylindrical portion 36*c* which can also have a slight press fit with the bore 32*a*, a cube portion 36*d* having forwardly and rearwardly projecting pins 36*e*, and a cylindrical shank portion 36*f*. Having mentioned the forwardly and rearwardly projecting pins 36*e* on the cube portion 36*d* of the arm mounting unit 36, it can now be appreciated that the torso 14 is provided with pin-receiving holes, there being one such hole in the forward or front shell and a similar hole in the rear shell. These holes are not visible in any of the views but they are simply molded of a size so that the two pins 36*e*, there being two such pins 36*e* associated with each arm mounting unit 36, are pivotally received in the holes. In this way, inasmuch as the arms 16 and 18 are mounted on the arm mounting units 36, the arms are capable of being manipulated in a lateral direction away from the sides of the torso 14. In other words, the pins 36*e* provide rocking axes 37*a* and 37*b* at each side of the torso 14 for the two arms 16 and 18.

While there exists a choice of plastics that can be utilized in fabricating the action FIG. 10, it perhaps should be pointed out at this stage of the description that the torso 14 can be of ABS plastic, whereas the arms 16 and 18 are preferably of a more resilient plastic, such as vinyl. When using a vinyl plastic for the arms 16 and 18, it will be understood that the shoulders 30 of these arms can be pressed over the flanges 36*b* so that the arm 16 and 18 in each instance is frictionally held in place, yet capable of being independently pivoted or swung forwardly and rearwardly about its particular mounting unit 36, the unit 36 under these circumstances functioning as a shoulder joint to allow such angular movement to be manually achieved when desired. The press fit is of course not so tight as to prevent such independent manual pivoting of either arm 16 or 18. However, when practicing the present invention, it is primarily intended that either or both arms 16 and 18 be swung laterally toward and away from the sides of the torso 14, being thus rocked about the forwardly and rearwardly extending axes 37*a* and 37*b* provided by the forwardly and rearwardly projecting pins 36*e*.

At this time it will be observed that each leg 22 and 24 has a hip labeled 38. The hip 38 in each instance includes a socket 40 comprised of a bore 42*a*, an annular groove 42*b* and a counterbore 42*c*. The lower portion of the torso 14 is formed with an integral bushing 44 at each side thereof, the bushing 44 projecting outwardly into the bore 42*a* of the hip socket 40.

Each leg 22 and 24 is provided with a leg mounting unit 46 comprised of a sleeve or cylindrical portion 46*a* passing through the center of the bushing 44, a flange 46*b* that is press fitted into the annular groove 42*b*, a cylindrical tip 46*c* that extends into the counterbore 42*c* and a thrust flange or disk 46*d* that retains each leg mounting unit 46 in place. The units 46 permit easy pivoting of the legs 22, 24.

Referring now to the actuating mechanism which has been denoted generally by the reference numeral 54, it will be observed from FIGS. 5, 7 and 13 that this mechanism includes a coil spring 56, the end portions of which receive the previously mentioned shank portions 36*f* belonging to the arm mounting units 36. Close inspection of FIGS. 5, 7 and 13 will reveal that the inner or adjacent ends of the two shanks 36*f* are spaced somewhat from each other. This spacing enables the coil spring 56 to be flexed into a generally inverted V shape when either arm 16 or 18 (or both arms) is pressed toward the side of the torso 14 (see FIG. 7) or flexed into a generally upright V shape when either arm 16 or 18 is pressed toward the other (see FIG. 13), either event occurring by reason of the rocking-type mounting provided by the pivot pins 36*e* that are integral with the arm mounting units 36, as earlier explained.

The actuating mechanism 54 further includes a transmission link 58 having a C-shaped clamp 60 at its upper end, the clamp 60 encircling the central portion of the coil spring 56. When the coil spring 56 is flexed into its V-shaped configuration, it follows that the C-shaped portion 60 of the link 58 is moved downwardly. Quite obviously, the link 58 also moves downwardly. The lower end of the link 58 is in the form of an inverted "T" 62. The forwardly and rearwardly extending legs of the "T" 62 are labeled 62*a* and 62*b*, respectively, each having an elongated slot 64*a*, 64*b* formed therein. From FIGS. 6, 8 and 14, it will be perceived that the slots 64*a*, 64*b* are spaced somewhat forwardly and rearwardly with respect to the longitudinal center line of the transmission link 58.

Although the flanges or disks 46*b* of each leg mounting unit 46 have been described as providing a retaining function, they perform an additional function, more specifically that of a crank. In this regard, it will be observed that the leg mounting unit 46 for the left leg 22 has a crank pin 66*a* projecting from the face thereof into the forward slot 62*a* and the leg mounting unit 44 for the right leg 24 has a pin 66*b* projecting into the rearwardly located slot 64*b*.

In operation, the actuation mechanism 54 performs an important role. All that the child need do is to press either or both arms 16, 18 toward the other. Such movement produces a rocking action about the axis provided by the pins 36*e*. Owing to the reception of the shanks 36*f* within the end portions of the coil spring 56, the shanks 36*f* being integral with the bearing units 36, they are instrumental in flexing the coil spring 56 whenever either arm 16 or 18 is moved.

When the coil spring 56 is flexed into an inverted V-shaped configuration (FIG. 7), the transmission link 58 is caused to move vertically upwardly because the upper end 60 thereof is clamped to the central portion of the coil spring 56. The pins 66*a*, 66*b* on the thrust flanges or disks 46*d* are located in an eccentric or offset relationship with the axes about which the mounting units 46 rotate, that is, the center line of the bushings 44. From FIG. 8, it should be understandable that when the transmission link 58 is forced upwardly, as it is when the coil spring 56 is flexed due to the pressing of the arms 16 and 18 inwardly, as in FIG. 7, then the upward stroke of the transmission link 58 moves both of the pins 66*a*, 66*b* upwardly. Since the pins 66*a*, 66*b* are eccentrically mounted on the thrust flanges or disks 46*d*, a crank-like action is provided by the time that the pins 66*a*, 66*b* move from the position in which they appear in FIG. 6 to the actuated position in which they appear in FIG. 8. Stated somewhat differently, the pins 66*a*, 66*b* are depicted at approximately 3 o'clock and 9 o'clock positions in FIG. 6, whereas in FIG. 8 they are shown in approximately 1 o'clock and 11 o'clock positions.

Figure 4:
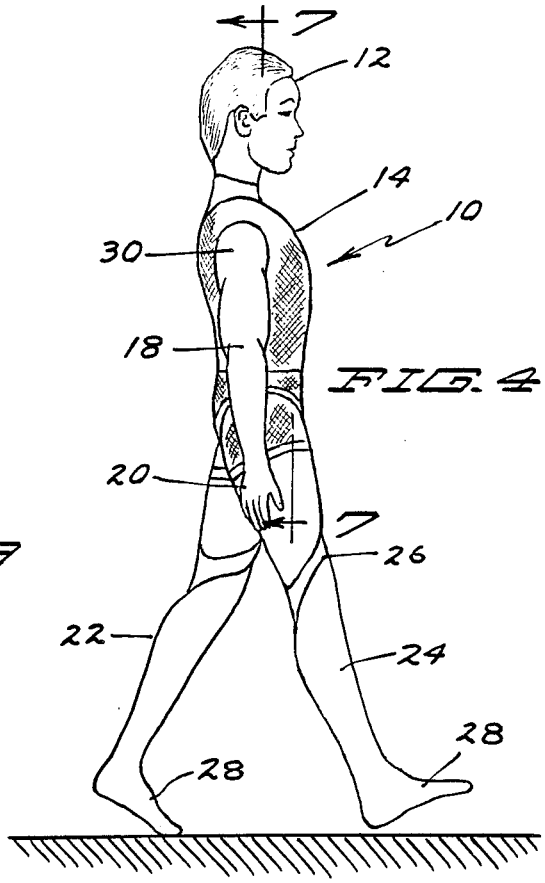
FIG. 4 is a side view corresponding to FIG. 2 but with the legs actuated as in FIG. 3.
Figure 6:
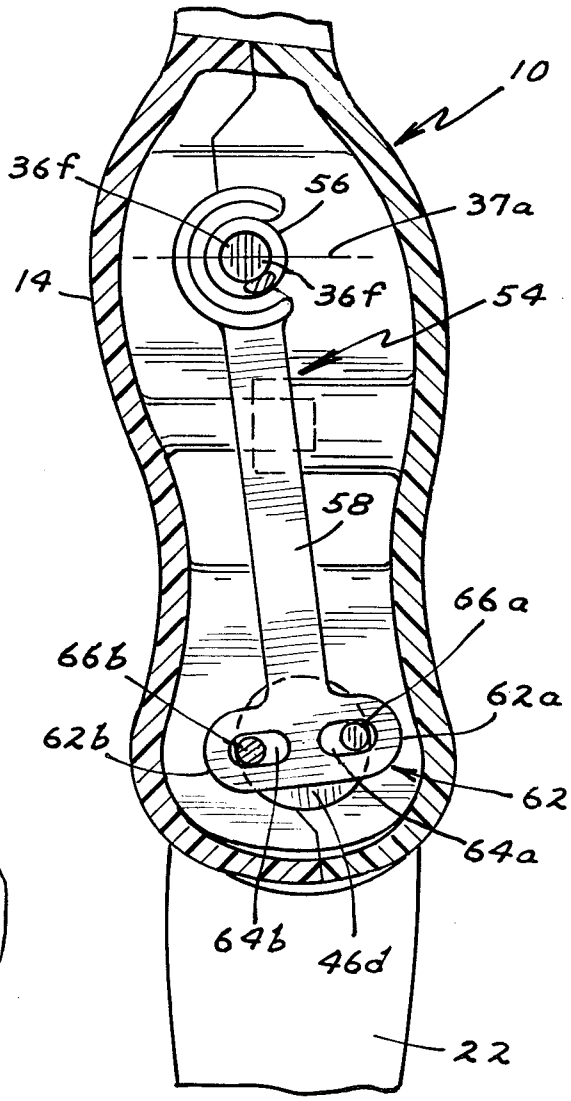
FIG. 6 is a sectional view taken in the direction of line 6—6 of FIG. 5.

Inasmuch as the two legs 22 and 24 are rotatable or pivotal by virtue of the bushings 44 that the leg mounting units 46 are contained in, it follows that since one pin 66*a* is forwardly of the center line of the torso 14, and the other pin 66*b* is rearwardly of the center line, that the upward travel of the transmission link 58 produces a pivoting or swinging of the legs 22 and 24 in opposite directions. Thus, as viewed in FIG. 4, the right leg 24 is moved forwardly and the left leg 22 is moved rearwardly. When the child releases whichever, or both, arms 16 and 18 that he/she has manually rocked, then the coil spring 56, being inherently resilient, returns from FIG. 7 to its original position which is shown in FIG. 6. This lowers the transmission link 58, returning the pins 66*a*, 66*b* from the position in which they have been actuated into, as far as FIG. 8 is concerned, back to the unactuated position in which they are shown in FIG. 6. If either or both arms 16, 18 is continually rocked toward the torso 14 in a lateral direction and then away from the torso, there is produced a forward and backward or scissors-like movement of the legs 22, 24 which movement simulates the movement of a person's legs when running. In other words, the inward or lateral manual movement of the arms 16 and 18 about the axes provided by the pins 36*e* will cause the legs 22, 24 to oscillate forwardly and rearwardly to resemble a running movement, as can be appreciated from FIGS. 1–4, especially FIG. 4.

It has already been explained that the arm mounting units 36 (as do the leg mounting units 46 for the legs 22, 24) enable the arms 16, 18 to be swung forwardly and rearwardly, the units 36 acting as shoulder joints. This feature permits the arms 16, 18 to be "raised" or swung above the head (when the FIG. 10 is vertical) or outstretched (when the FIG. 10 is prone, as in FIGS. 9–12).

FIGS. 9 and 10 represent an unactuated condition of the FIG. 10. Therefore, the FIG. 10 could be considered as merely floating in the water 100 of FIG. 10. However, by pressing the outstretched arms 16, 18, as seen in FIG. 9, toward each other, as seen in FIG. 11, such manual actuation causes the coil spring 56 to flex into the V-shaped configuration of FIG. 13 in contradistinction to the inverted V-shaped configuration of FIG. 7, the latter situation already having been described. The transmission link 58, under these circumstances, is caused to move vertically downwardly because it will be recalled that the upper end 60 thereof is clamped to the central portion of the coil spring 56. The central portion of the coil spring 56 can move either up or down, in this situation, the movement is down.

From FIG. 14, it will be perceived that when the transmission link 58 is forced downwardly (as viewed in FIG. 13), then the downward stroke of the transmission link 58 moves both of the pins 66*a*, 66*b* downwardly. As earlier herein pointed out, a crank-like action is provided; this time, though, the pins 66*a*, 66*b* move from the position in which they appear in FIG. 6 to the actuated position in which they appear in FIG. 14. In other words, the pins 66*a*, 66*b* are depicted at approximately 3 o'clock and 9 o'clock positions in FIG. 6, whereas in FIG. 14 they have moved into approximately 1 o'clock and 11 o'clock positions.

Inasmuch as the two legs 22 and 24 are rotatable or pivotal by reason of the bushings 44 that the leg mounting units are contained in, it develops that since one pin 66*a* is forwardly at the center line of the torso 14 in FIG. 14, and the other pin 66*b* is rearwardly at the center line, that the downward travel of the transmission link 58 produces a pivoting or swinging of the legs in opposite directions. As viewed in FIG. 12, which is a prone position of the FIG. 10 rather than a vertical position thereof, the right leg 24 is moved downwardly and the left leg 22 is moved upwardly in a scissors-like fashion to resemble a swimming action. As with FIGS. 1 and 2, the coil spring 56 is instrumental in returning the legs 22, 24 to their normal or unactuated positions in FIGS. 9 and 10 when the child ceases to exert manual pressure on the arms 16, 18. Repeated application of pressure on the arms 16, 18 produces a leg oscillation closely simulating a swimming movement.

While both legs 22 and 24 are oscillated in the two foregoing illustrative situations, only one leg 22 or 24 need be actuated. The actuation of but one leg would occur when the action FIG. 10 is to look like a comic strip character that is known for his kicking traits. By merely omitting, say, the pin 66*b* at the factory, just the leg 24 would be actuated. Furthermore, any limb, whether it be one of the arms 16 or 18, or one of the legs 22 or 24, can be rotated into various life-like positions about the equivalent of a shoulder joint or a hip joint, as the case may be, without interfering with the rocking movement and the resulting leg movement. Consequently, it will be recognized that the invention does possess a considerable amount of utility, thereby lending itself to looking like and acting like various cartoon characters if so desired.

We claim:

1. A toy action figure comprising a hollow torso, first and second arms, first means mounting said first arm to said torso for lateral rocking movement about a first axis, first and second legs, second means mounting said first leg to said torso for pivotal movement about a second axis, and an actuating mechanism within said torso connecting said first arm to said first leg for causing the pivotal movement of said first leg about said second axis by transmitting movement of said first arm to said first leg when said first arm is rocked about said first axis in a lateral direction relative to one side of said torso, said actuating mechanism including coil spring means having one end portion thereof coupled to said first means and further including third means coupled to said coil spring means at a location spaced from said first means, said spring means and said third means connecting said first arm to said first leg through said first and second means.

2. A toy action figure in accordance with claim 1 in which said second axis is perpendicular to said first axis.

3. A toy action figure in accordance with claim 1 in which said first arm normally extends at a greater angle relative to said torso and is rocked about said first axis into a lesser angle relative to said torso to cause pivotal movement of said first leg.

4. A toy action figure in accordance with claim 1 in which said first arm is pivotable about a third axis generally perpendicular to said first axis.

5. A toy action figure in accordance with claim 1 in which said one end portion of said spring means is coupled directly to said first means and said third means is coupled directly to said second means, said third means including a transmission link having one end thereof engaged with said spring means at said location spaced from said first axis to effect pivotal movement of said first leg when said first arm is rocked.

6. A toy action figure in accordance with claim 5 in which said spring means is in the form of a single coil, one end portion of said coil providing said one end portion of said spring means.

7. A toy action figure in accordance with claim 6 in which said link has at least one slot in its other end, said legs mounting means having a crank pin received in said slot so that when said first arm is rocked about said first axis, said link is moved upwardly or downwardly to cause said crank pin to rotate said second means on which said first leg is mounted.

8. A toy action figure comprising a hollow torso, first and second arms, first means mounting said first arm to said torso for lateral rocking movement about a first axis, first and second legs, second means mounting said first leg to said torso for pivotal movement about a second axis, and an actuating mechanism within said torso connecting said first arm to said first leg for causing the pivotal movement of said first leg about said second axis when said first arm is rocked about said first axis in a lateral direction relative to one side of said torso, said actuating mechanism including a coil spring coupled to said first means and a link connected at one end to said coil spring having at least one slot in its other end, said second mounting means having a crank pin received in said slot so that said link is moved by said spring to effect pivotal movement of said first leg when said first arm is rocked, a second first means mounting said second arm to said torso for lateral rocking movement about another axis, said mounting means for said first arm having a shank portion thereof received in one end portion of said coil spring and said mounting means for said second arm having a shank portion thereof received in the other end portion of said coil spring, whereby if either arm is rocked, motion is transmitted to said one leg via said transmission link.

9. A toy action figure in accordance with claim 8 in which there is a mounting unit for said second leg having a second crank pin, the lower end of said transmission link having a second slot in which said second crank pin is received, said first and second crank pins being offset with respect to each other so that when said transmission link is actuated by said coil spring, then said first and second crank pins cause said first and second legs to pivot in opposite directions.

10. A toy action figure comprising a hollow torso, first and second arms mounted on said torso, first means mounting said first arm to said torso for rocking movement about a first axis extending forwardly and rearwardly relative to said torso, said first mounting means projecting into said first arm to permit angular movement of said first arm relative to said torso about a second axis extending laterally from said torso and at right angles to said first axis; first and second legs mounted on said torso, second means mounting said first leg to said torso for pivotal movement relative to said torso about a third axis extending parallel to said second axis, and an actuating mechanism within said torso including resilient means and rigid means connecting said first arm to said first leg for causing the physical movement of said first leg about said third axis as a result of said first arm being rocked about said first axis and when said arm is in either of two angular positions on said second axis.

11. A toy action figure in accordance with claim 10 in which said first arm has a shoulder socket, said first mounting mean projecting into said shoulder socket to permit angular movement of said first arm about said second axis.

12. A toy action figure in accordance with claim 11 in which said socket has a cylindrical bore and an annular groove extending therearound, and said first mounting means includes a cylindrical portion received in said cylindrical bore and a flange on said cylindrical portion received in said annular groove, said cylindrical portion and flange having a fit with said bore and groove to allow said angular movement of said first arm about said second axis.

13. A toy action figure comprising a torso, first and second arms, respective means mounting each of said arms to a respective side of said torso for rocking movement in a direction laterally with respect to the sides of said torso, a coil spring extending between and connecting said respective mounting means and capable of being flexed when either of said arms is rocked, a transmission link connected to a central portion of said coil spring and extending downwardly, the lower end of said transmission link having a first forwardly located slot and a second rearwardly located slot, first and second legs, means mounting each of said legs for pivotal movement at a respective side of said torso, each of said legmounting means including a crank pin receivable in one of said slots, whereby when either arm is rocked, said coil spring assumes a V shape to cause said transmission link to move upwardly or downwardly and to act against said crank pins to rotate the respective mounting means for said legs, causing said legs to pivot in opposite directions.

14. A toy action figure in accordance with claim 13 in which each of said arm-mounting means includes a shank portion extending into an end portion of said coil spring but not extending to the central portion of said coil spring where said transmission link is connected.

15. A toy action figure in accordance with claim 14 in which said arm-mounting means also mount said arms for pivotal movement in angular directions generally corresponding to those of said legs.

16. A toy action figure comprising a hollow torso, first and second arms mounted to said torso, first means mounting said first arm to said torso for rocking movement about a first axis, said first means including a shank extending into said torso, first and second legs mounted to said torso, second means mounting said first leg to said torso for pivotal movement about a second axis and including a crank pin, a spring connected to said shank for biasing said shank in one direction in response to rocking said first arm in an opposite direction laterally about said first axis relative to said torso, and a link attached to said spring extending between said spring and said crank pin and rotatably engaged with said crank pin, whereby when said first arm is rocked about said first axis relative to said torso in a lateral direction with respect to said torso, the motion thereof is transmitted via said shank, spring, link and second means to cause said first leg to pivot about said second axis.

17. A toy action figure in accordance with claim 16 in which said first and second axes are generally perpendicular to each other.

18. A toy action figure in accordance with claim 17 in which said spring is a coil spring and said one direction is away from said torso.

19. A toy action figure in accordance with claim 18 in which one end of said spring is connected to the inner end of said shank, and oppositely directed pin means at the other end of said shank being pivotally mounted to said torso to provide said first axes.

* * * * *

UNITED STATES PATENT AND TRADEMARK OFFICE

CERTIFICATE OF CORRECTION

PATENT NO. : 4,578,045

DATED : March 25, 1986

INVENTOR(S) : John F. Mayer, Nick H. Langdon, Stuart A. Cook, L. Todd Nicholson, and John R. Belcher It is certified that error appears in the above-identified patent and that said Letters Patent are hereby corrected as shown below:

Col. 1, lines 35 and 36; "Two or more" should be -- Two more --,

Col. 3, line 34; "action FIG. 10" should be -- action figure 10 --, lines 36 and 37; "action FIG. 10" should be -- action figure 10 --, lines 38 and 39; "action FIG. 10" should be -- action figure 10 --, Col. 4, line 14; "action FIG. 10" should be -- action figure 10 --, Col. 6, line 19; "the FIG. 10" should be -- the figure 10 --, line 20; "the FIG. 10" should be -- the figure 10 --, line 22; "the FIG. 10" (first and second occurrence) should be -- the figure 10 --, line 56; "the FIG. 10" should be -- the figure 10 --, Col. 7, line 1; "action FIG. 10" should be -- action figure 10 --, line 57; "legs mounting" should be -- leg-mounting --,

UNITED STATES PATENT AND TRADEMARK OFFICE

CERTIFICATE OF CORRECTION

PATENT NO. : 4,578,045 Page 2 of 2

DATED : March 25, 1986

INVENTOR(S) : John F. Mayer, Nick H. Landon, Stuart A. Cook, L. Todd Nicholson, and John R. Belcher It is certified that error appears in the above-identified patent and that said Letters Patent is hereby corrected as shown below:

Col. 8, line 49; "mounting mean" should be -- mounting means --,

Col. 9, line 6; "legmounting" should be -- leg-mounting --.

Signed and Sealed this

*Seventeenth* Day of *June 1986*

[SEAL]

*Attest:*

DONALD J. QUIGG

*Attesting Officer* *Commissioner of Patents and Trademarks*